United States Patent [19]

Norton

[11] Patent Number: 4,801,243

[45] Date of Patent: Jan. 31, 1989

[54] ADJUSTABLE DIAMETER SCREW PROPELLER

[75] Inventor: John A. Norton, Norwell, Mass.

[73] Assignee: Bird-Johnson Company, Walpole, Mass.

[21] Appl. No.: 120,247

[22] Filed: Nov. 3, 1987

Related U.S. Application Data

[63] Continuation of Ser. No. 792,064, Dec. 28, 1985, abandoned.

[51] Int. Cl.[4] ..... B63H 1/22

[52] U.S. Cl. ..... 416/89; 416/142; 416/202; 416/238

[58] Field of Search ..... 416/87–89, 416/142 R, 142 A, 142 C, 202, 238, 166

[56] References Cited

U.S. PATENT DOCUMENTS

| | | | |
|---|---|---|---|
| D. 141,235 | 5/1945 | Birsh | 416/202 X |
| 938,291 | 10/1909 | Thompson | 416/142 A |
| 993,126 | 5/1911 | Thompson | 416/142 A |
| 997,884 | 7/1911 | Wells | 416/142 R |
| 1,947,560 | 2/1934 | Manasek | 416/202 X |
| 2,012,987 | 9/1935 | Chillingworth | 416/142 |
| 2,134,660 | 10/1938 | Everts | 416/87 X |
| 2,374,833 | 5/1945 | Rippingille | 416/202 X |
| 2,481,751 | 9/1949 | James . | |
| 2,528,609 | 11/1950 | Rouse | 416/89 R |
| 3,226,031 | 12/1965 | Holland | 416/223 R |
| 3,565,544 | 2/1971 | Marshall | 416/89 R |
| 3,589,647 | 6/1971 | Burkham | 416/142 R X |
| 4,364,711 | 12/1982 | Brandt et al. | 416/142 A |
| 4,427,341 | 1/1984 | Eichler | 416/142 |
| 4,565,531 | 1/1986 | Kimon | 416/87 X |

FOREIGN PATENT DOCUMENTS

| | | | |
|---|---|---|---|
| 860029 | 12/1952 | Fed. Rep. of Germany | 416/202 |
| 2300812 | 7/1974 | Fed. Rep. of Germany | 416/142 A |
| 370283 | 2/1907 | France | 416/142 A |
| 1294296 | 4/1962 | France | 416/238 |
| 227592 | 12/1984 | Japan | 416/142 A |
| 22189 | 12/1895 | United Kingdom | 416/87 |
| 4504 | 2/1908 | United Kingdom | 416/87 |
| 26090 | 11/1909 | United Kingdom | 416/142 A |
| 21920 | 10/1911 | United Kingdom | 416/142 A |

OTHER PUBLICATIONS

"Propeller's Pitch, Diameter Adjust Automatically", by David J. Bak, East Coast Editor, taken from Design News, 1-21-85.

*Primary Examiner*—Everette A. Powell, Jr.
*Attorney, Agent, or Firm*—Brumbaugh, Graves, Donohue & Raymond

[57] ABSTRACT

An adjustable diameter screw propeller includes a hub having a plurality of spindles, each mounted in the hub for rotation about an axis disposed radially of the hub axis and a mechanism for synchronously turning the spindles in a common direction. A plurality of propeller blades having a fixed pitch contour and a skew in the range of 60° to 90° are attached to respective ones of the spindles, such that as the spindles are turned, the blades rotate between a first disposition in which the diameter of the propeller is maximum and a second disposition in which the diameter of the propeller is reduced. In addition, the pitch of the propeller increases as the propeller diameter decreases to compensate for the loss of power that would otherwise occur as the propeller diameter is decreased.

3 Claims, 3 Drawing Sheets

ADJUSTABLE DIAMETER SCREW PROPELLER

This application is a continuation of application Ser. No. 792,064, filed on 10/28/85 now abandoned.

BACKGROUND OF THE INVENTION

The present invention relates to adjustable diameter screw propellers and, more particularly, to propellers in which the diameter may be adjusted over a relatively large range and in which the pitch of the propeller increases as the diameter is decreased to compensate for loss of power of the propeller as its diameter is reduced.

It is known that a large ship, such as a tanker, bulk carrier or the like, can be operated more efficiently if driven by a relatively large diameter propeller (e.g., 20 to 40 feet or larger) turning at a relatively slow speed. The advantageous use of a large diameter propeller is described, for example, in "Large Diameter Propellers of Reduced Weight" by J. B. Hadler, R. P. Neilson, A. L. Rowan, R. D. Sedat, F. Seibold, and R. B. Zubal, Transactions of the Society of Naval Architects and Marine Engineers, 1982. The use of such a large diameter propeller, however, is normally not possible because the tips of the propeller blades would extend below the bottom of the ship's keel, thus creating a risk that the propeller and other parts of the ship's propulsion systems may be damaged if the ship is inadvertently grounded in shallow waters. Furthermore, the use of a large diameter propeller has the added disadvantage in that the ship is required to maintain a relatively deep draft in order to prevent the tips of the propeller blades from approaching too close to the water surface, since the blades of a larger propeller extend further in the vertical direction than those of a smaller propeller. If the tips of the propeller blades approach too close to the water surface or break the water surface, the cavitation or ventilation created by the propeller operating in such a manner results in losses that can offset the efficiency gained by using a large diameter propeller.

The latter disadvantage is of particular importance in a variable load vessel, such as a tanker, which operates a high percentage of the time in an unloaded or lightly loaded condition at minimum draft. Therefore, if a large diameter propeller is used in such a vessel, it is necessary to provide additional ballast or to trim the vessel to be lower at the stern than at the bow in order to insure that the propeller will be fully submerged when the vessel is unloaded or lightly loaded. However, the use of additional ballast or a greater trim at the stern increases the power needed to propel the otherwise unloaded or lightly loaded ship, thereby again offsetting the efficiency gained from using a large diameter propeller.

Recently, it has been recognized that the above-mentioned drawbacks of a large propeller are overcome by using a propeller whose diameter could be adjusted over a wide range, e.g., 20% to 50%, such that a ship could operate with a relatively large diameter propeller when fully loaded and in deep waters but could also reduce the size of its propeller when lightly loaded or in shallow waters.

Known configurations for adjustable diameter propellers typically include a hub, two or more propeller blades each mounted to pivot about a respective transverse pin in the hub and a mechanism within the hub for tilting each blade between a position in which each blade is substantially perpendicular to the axis of rotation of the hub and a position in which each blade is inclined towards the aft end of the hub.

Such known blade tilting configurations for adjustable diameter propellers have the shortcoming in that the mechanism for tilting the propeller blades is generally difficult to implement for large propellers, such as those which are 20 to 40 feet in diameter or larger. Furthermore, it is also difficult to reliably seal such a mechanism to prevent leakage of water from outside the hub.

In an adjustable diameter propeller, it is desirable to have the pitch of the propeller increase as the propeller diameter is decreased, since for a fixed pitch and rpm the power of a propeller decreases with decreasing diameter. Therefore, having the pitch increase with decreasing propeller diameter would compensate for such loss of power. Known blade tilting configurations for varying the propeller diameter have the additional shortcoming in that the pitch of the propeller generally does not change as the propeller blades are tilted towards the aft end of the hub.

Accordingly, a need clearly exists for a screw propeller construction which provides for adjustment of the propeller diameter over a relatively wide range and for increasing the pitch of the propeller as its diameter is decreased and which includes a mechanism for propeller diameter adjustment that is suitable for relatively large propellers and reliably sealed from water outside the hub and for retention of lubrication for the mechanisms within the hub.

Conventional adjustable pitch propellers, in which the propeller blades are attached to rotatable radial spindles in the hub, have blades which are in some instances skewed, in that the angle between the axis of the spindle and the radius line from the axis of the hub to the tip of the propeller blade attached to the spindle is greater than zero. The purpose of such skew, which is typically 25° or less, on an adjustable pitch propeller is to avoid vibration of the propeller caused by each blade as it passes through the turbulence in the water behind the ship. The presence of such blade skew in a conventional adjustable pitch propeller results in an incidental reduction in the diameter of the propeller as the blades are rotated in a direction to increase the propeller pitch. However, for the degree of blade skew used in conventional adjustable pitch propellers, the extent of the change in propeller diameter is small, e.g., less than 5%, and the use of blade skew in such propellers is not intended to make the propeller diameter adjustable.

SUMMARY OF THE INVENTION

The foregoing and other disadvantages of the prior art are overcome and the aforementioned need is fulfilled, in accordance with the present invention, by a novel adjustable diameter screw propeller construction having a hub similar to that of a conventional adjustable pitch propeller, in which a plurality of rotatable spindles extend radially from within the hub to a position adjacent to the surface of the hub. The spindles are coupled to a mechanism within the hub for synchronously turning each spindle about its axis in a common direction. The propeller further comprises a plurality of propeller blades attached to respective ones of the spindles, each blade having a predetermined pitch contour and a skew in the range of 60° to 90°. As the spindles are turned, the propeller blades synchronously rotate between a first disposition in which the propeller blades are substantially transverse to the hub axis and the diameter of the propeller is a maximum and a second disposition in which the propeller blades are inclined towards the aft end of the hub and the diameter of the propeller is reduced. With the foregoing configuration, the pitch of the propeller is increased as the propeller diameter is decreased by the rotation of the blades.

In the preferred embodiment of the present invention, each of the spindles in the hub terminates in an attachment member perpendicularly disposed with respect to the axis of the spindle and being situated adjacent the surface of the hub. Each of the propeller blades comprises a working portion having a predetermined pitch angle at each point along its length and a root portion angled with respect to the working portion. The root portion of each blade terminates in a longitudinally disposed flange attached to the attachment member of the respective spindle. The working portion of each blade is substantially transverse to the axis of the hub when the blade is in the first position and is inclined towards the aft end of the hub when the blade is in the second position.

BRIEF DESCRIPTION OF THE DRAWING

The present invention may be better understood with reference to the following detailed description of the preferred embodiment, taken in conjunction with the accompanying drawing, in which.

Throughout the figures of the drawing, the same reference numerals and characters are used to denote like features, components or structural parts of the illustrated apparatus.

DETAILED DESCRIPTION

Figure 1:
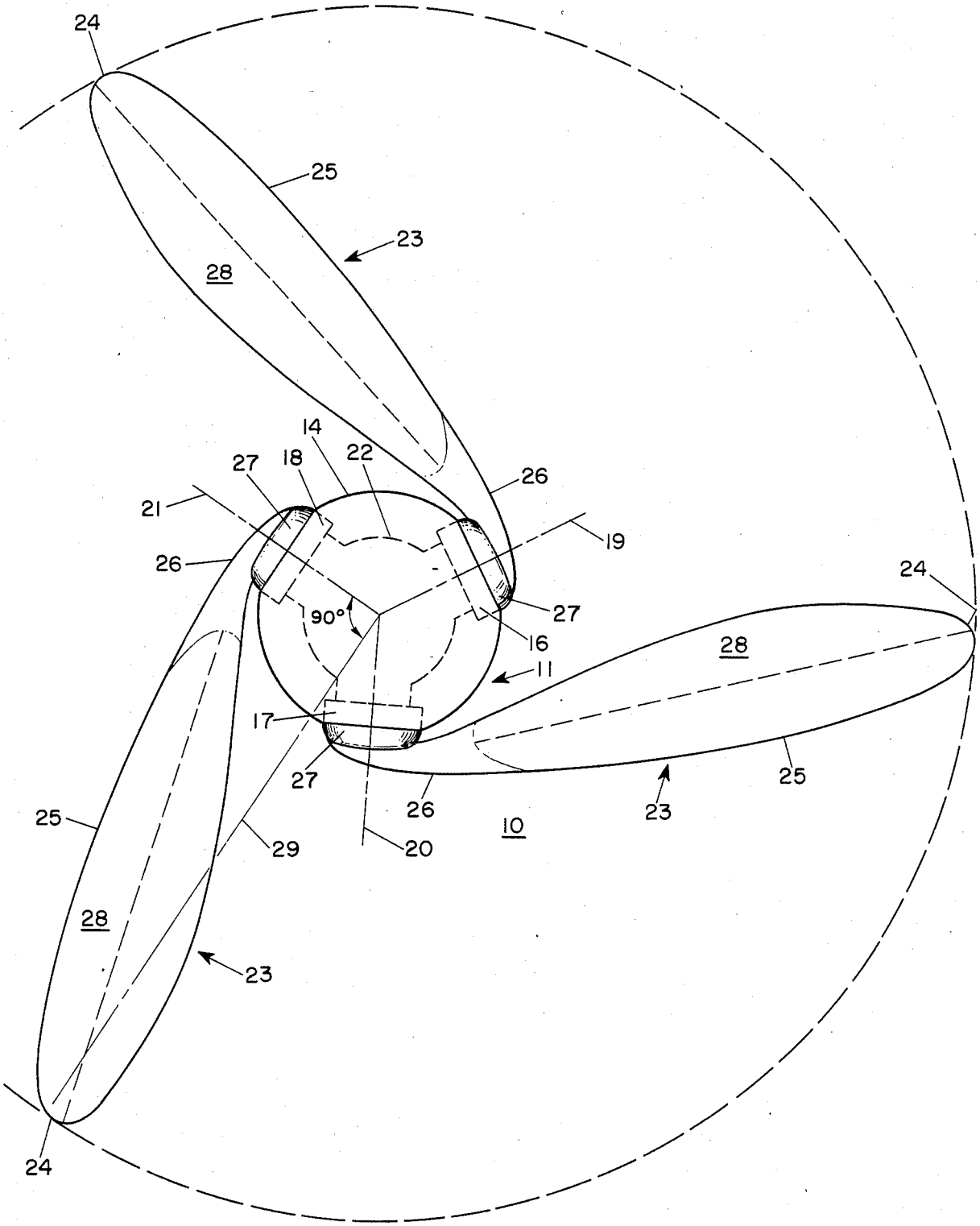
FIG. 1 is an elevational view from the aft end of an adjustable diameter propeller in accordance with the present invention showing the blades of the propeller positioned for maximum propeller diameter and the spindles and the spindle turning mechanism schematically represented in broken line.
Figure 2:
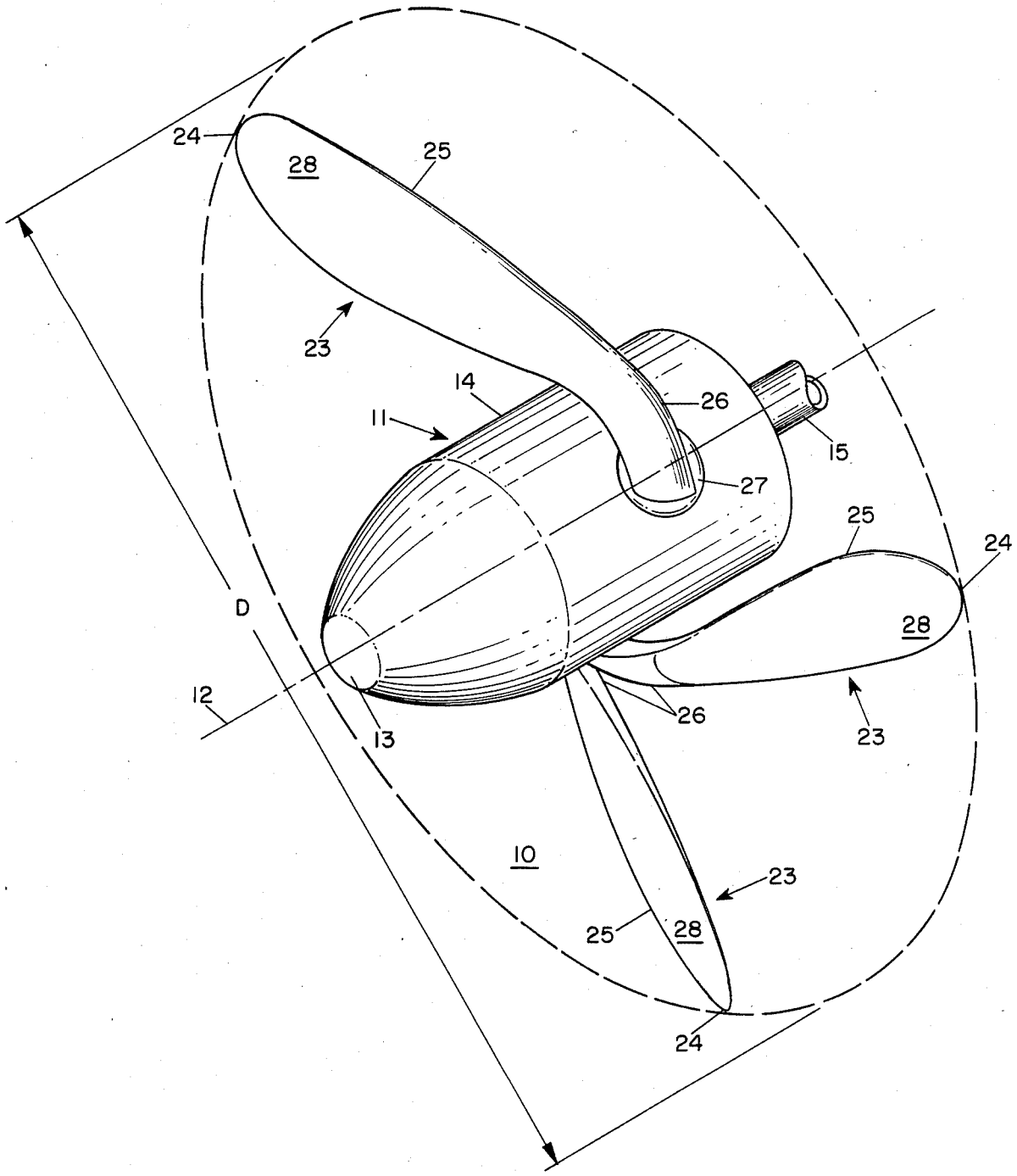
FIG. 2 is a perspective view of the propeller of FIG. 1 showing the blades of the propeller positioned for maximum propeller diameter.
Figure 3:
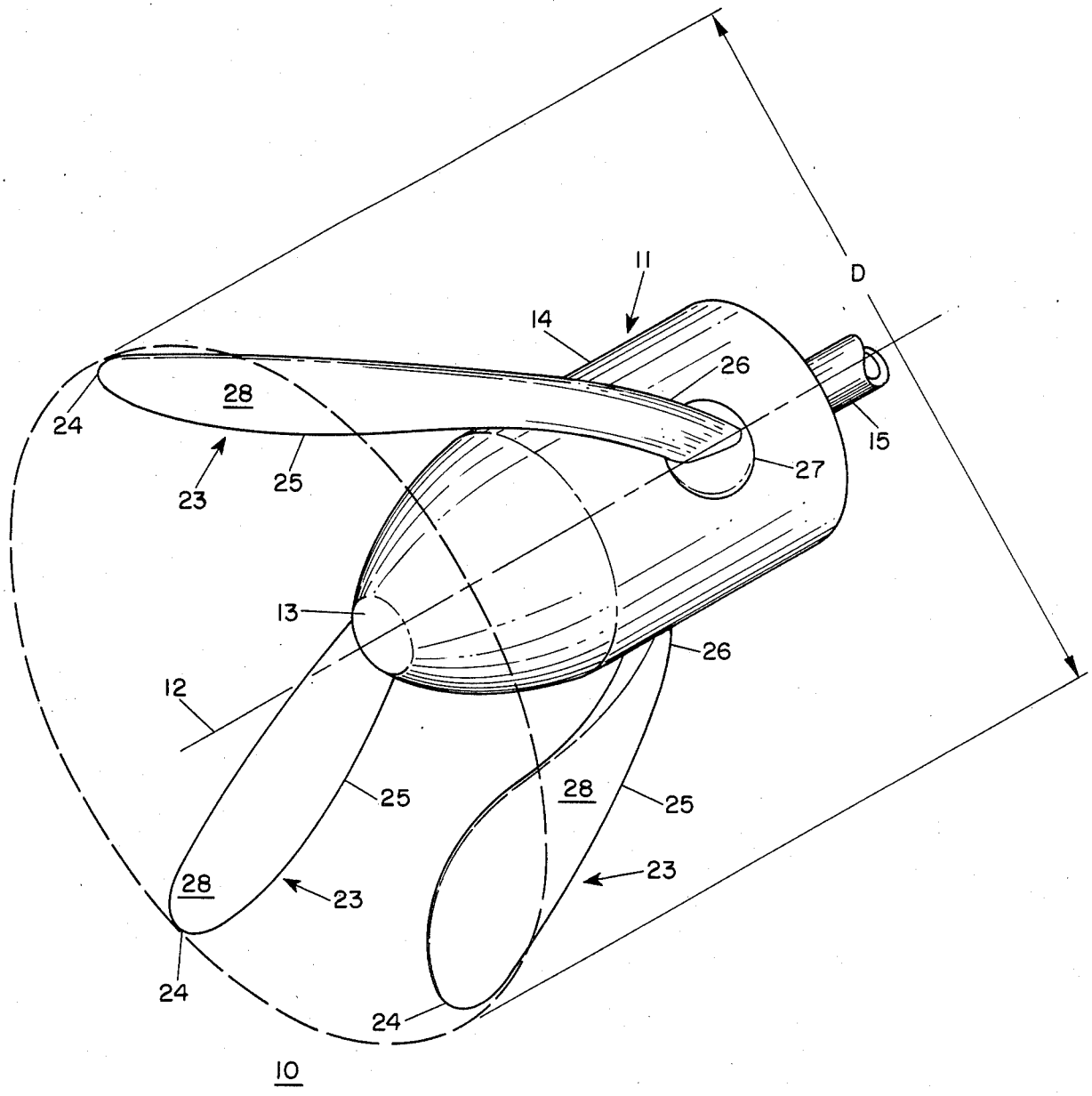
FIG. 3 is a perspective view of the propeller of FIG. 1 showing the blades of the propeller positioned for reduced propeller diameter.

Referring now to FIGS. 1, 2 and 3 the propeller 10 of the present invention includes a hub 11 having an axis of rotation 12, a tapered aft end 13 and a surface 14 formed generally as a surface of revolution. The hub 11 is adapted to be coupled coaxially to a rotatable drive shaft 15 in a conventional manner.

Situated within the hub 11 are three rotatable spindles comprising attachment members 16, 17 and 18, which are mounted in the hub 11 and positioned adjacent to the surface 14 of the hub 11. Each of the spindles 16, 17 and 18 has an axis of rotation 19, 20 and 21, respectively, which lies in a common plane (not shown) perpendicular to the axis of rotation 12 of the hub 11.

The hub 11 also houses a mechanism 22 for synchronously rotating each of the spindles 16, 17 and 18 about its axis of rotation in a common direction. The spindles 16, 17 and 18 and the mechanism 22 for turning the spindles may be of the type used for rotating propeller blades in conventional variable pitch propellers for large ships. For example, generally suitable designs for the spindles and the spindle turning mechanism are described in U.S. Pat. No. 2,794,508.

The hub 11 also includes appropriate packing (not shown) around each spindle 16, 17 and 18 for preventing water outside the hub from leaking into the spindle turning mechanism. The packing used may be of the same type as used in conventional variable pitch propellers. Generally suitable packing techniques are described in U.S. Pat Nos. 2,516,191 and 2,676,041.

Attached to each one of the spindles 16, 17 and 18 is an identical propeller blade 23 comprising a tip 24, a working portion 25 and a root portion 26 angled with respect to the working portion 25. The root portion 26 of each blade 23 terminates in a flange 27, which is attached to the crank ring of a respective one of the spindles 16, 17 and 18 by conventional means, such as with threaded bolts.

The working portion 25 of each blade has a face 28 with a predetermined pitch contour, the pitch contour being the variation in pitch angle over the face of the blade. The pitch angle is the angle between the blade face 28 and a reference plane perpendicular to the axis of rotation 12 of the hub 11 when the blade 23 is transversely oriented with respect to the axis of rotation of the hub. The overall contour of the blade 23 may be the same as would be used in a fixed diameter propeller having the same blade configuration, pitch and operating requirements, and is advantageously designed using computer aided design tools, such as the PBD 10 Propeller Blade Design Program available from the Massachusetts Institute of Technology. In general, the blade face is designed such that the pitch angle decreases along the length of the working portion 25 of the blade 23 so as to develop the required hydrodynamic forces along the length of the blade. The term pitch refers to the distance a propeller blade or a portion thereof advances in one revolution of the propeller, assuming that there is no slippage.

It is noted that each of the blades 23 of the propeller 10 has a relatively large skew of 90°. The term skew as used herein and in the claims is defined as the angle between a radius line 29 (see FIG. 1) extending from the axis 12 of the hub 11 to the tip 24 of a blade 23 and the axis 21 of the spindle 18 to which the blade is attached. As will be further explained hereinbelow, the relatively large skew of the blades of the propeller of the present invention is a feature of primary importance.

The spindle turning mechanism 22 within the hub 11 is adapted to synchronously turn the spindles 16, 17 and 18 over a range of angles such that the propeller blades 23 swing between a first disposition in which each blade is substantially transverse to the hub axis 12 and the propeller has a maximum diameter D (see FIG. 2) and a second disposition in-which each blade is inclined towards the aft end of the hub and the propeller has a reduced diameter d (see FIG. 3). The diameter of the propeller is defined as the diameter of the circular path traced out by the blade tips 24 as the propeller 10 is rotated about its axis 12. The variation in the propeller diameter from its maximum value D to its reduced value d should advantageously be in the range of 20% to 50%. For a blade skew of 90°, a 20% reduction in propeller diameter corresponds to a spindle rotation of approximately 37° and a 50% reduction in propeller diameter corresponds to a spindle rotation of approximately 60°. Therefore, owing to the relatively large blade skew used in the propeller of the present invention, the propeller diameter may be varied over a wide range with spindle rotations that are obtainable with conventional spindle turning mechanisms used in variable pitch propellers. As indicated above, conventional variable pitch propellers have not heretofore provided for variation of this propeller diameter over a wide range.

The skew of the propeller blades 23 is advantageously in the range from 60° to less than 90°. In addition to providing a relatively large variation in propeller diameter, skew in this range allows the pitch of the propeller to increase at an appropriate rate as the propeller diameter decreases to compensate for the loss of power that would otherwise occur as the propeller diameter is decreased. It is noted that for a blade skew equal to 90°, the pitch of the propeller 10 remains substantially constant as the propeller diameter is decreased. In some instances, an adjustable diameter propeller in which the propeller pitch is substantially independent of propeller diameter, is desirable. For a blade skew of greater than 90°, the pitch at the tip 24 of the propeller 10 decreases as the propeller diameter is decreased.

It will be understood that various modifications and alterations may be made to the disclosed embodiment by one skilled in the art without departing from the spirit and scope of the present invention as defined by the appended claims. For example, a propeller according to the present invention may have any number of blades consistent with known design limitations and the blades used may have shapes and contours that differ from those shown in the drawings.

I claim:

1. A continuously adjustable diameter marine propeller comprising:

a hub having an axis of rotation, an aft end and a surface formed as a surface of revolution, the hub being adapted to be coaxially coupled to a rotatable drive shaft;

a plurality of rotatable spindle means, each mounted in the hub for rotation about an axis disposed radially of the hub axis and positioned adjacent to the surface of the hub;

a plurality of propeller blades attached to respective one so the spindle means, each blade having a predetermined pitch contour and a skew in the range of 60° to 90°; and means for synchronously turning each of the spindle means about its axis in a common direction so as to cause each of the blades to synchronously rotate between a first disposition in which the blade is held against applied loads in an orientation substantially transverse to the axis of the hub and the diameter of the propeller is maximum, and a substantially continuous range of second dispositions in which the blade is held against applied loads in respective orientations inclined towards the aft end of the hub and the diameter of the propeller is reduced up to 50% of the maximum diameter, whereby the pitch of the propeller increases as the diameter of the propeller decreases.

2. An adjustable diameter propeller according to claim 1, wherein each blade comprises a working portion having a predetermined pitch angle at each point along the length thereof and a root portion angled with respect to the working portion and terminating in a longitudinally disposed flange attached to an attachment member of the respective spindle means, the working portion of each blade being substantially transversely oriented with respect to the axis of the hub when the blade is in the first disposition and being inclined towards the end of the hub when the blade is in the second disposition.

3. A continuously adjustable diameter marine propeller comprising:

a hub having an axis of rotation, an aft end and a surface formed as a surface of revolution, the hub being adapted to be coaxially coupled to a rotatable drive shaft;

a plurality of rotatable spindle means, each mounted in the hub for rotation about an axis disposed radially of the hub axis and positioned adjacent to the surface of the hub;

a plurality of propeller blades attached to respective ones of the spindle means, each blade having a predetermined pitch contour and a skew of 90°; and means for synchronously turning each of the spindle means about its axis in a common direction so as to cause each of the blades to synchronously rotate between a first disposition in which the blade is held against applied loads in an orientation substantially transverse to the axis of the hub and the diameter of the propeller is maximum, and a substantially continuous range of second dispositions in which the blade is held against applied loads in respective orientations inclined towards the aft end of the hub and the diameter of the propeller is reduced up to 50% of the maximum diameter, whereby the pitch of the propeller remains substantially constant as the diameter of the propeller decreases.

* * * * *

UNITED STATES PATENT AND TRADEMARK OFFICE

CERTIFICATE OF CORRECTION

PATENT NO. : 4,801,243

DATED : January 31, 1989

INVENTOR(S) : John A. Norton

It is certified that error appears in the above-identified patent and that said Letters Patent is hereby corrected as shown below:

First page, Item 63, "Dec. 28, 1985" should read -- Oct. 28, 1985 --. Col. 5, line 42, "one so" should read -- ones of --.

Signed and Sealed this

Seventh Day of November, 1989

*Attest:*

JEFFREY M. SAMUELS

*Attesting Officer*

*Acting Commissioner of Patents and Trademarks*